US012240658B2

(12) United States Patent
Bisio

(10) Patent No.: US 12,240,658 B2
(45) Date of Patent: Mar. 4, 2025

(54) RECLOSABLE CONTAINER WITH PROTECTION FOR THE DISPENSING MOUTH

(71) Applicant: BISIO PROGETTI S.P.A., Alessandria (IT)

(72) Inventor: Luigi Bisio, Alessandria (IT)

(73) Assignee: BISIO PROGETTI S.P.A., Alessandria (IT)

( * ) Notice: Subject to any disclaimer, the term of this patent is extended or adjusted under 35 U.S.C. 154(b) by 13 days.

(21) Appl. No.: 18/035,047

(22) PCT Filed: Nov. 16, 2021

(86) PCT No.: PCT/IB2021/060606
§ 371 (c)(1),
(2) Date: May 2, 2023

(87) PCT Pub. No.: WO2022/118123
PCT Pub. Date: Jun. 9, 2022

(65) Prior Publication Data

US 2024/0002107 A1 Jan. 4, 2024

(30) Foreign Application Priority Data

Dec. 1, 2020 (IT) ..... 102020000029303

(51) Int. Cl.
*B65D 39/16* (2006.01)
*B65D 1/09* (2006.01)
(Continued)

(52) U.S. Cl.
CPC ..... *B65D 39/16* (2013.01); *B65D 1/09* (2013.01); *B65D 39/0029* (2013.01);
(Continued)

(58) Field of Classification Search
CPC . B65D 1/00; B65D 39/16; B65D 1/09; B65D 39/00–0029; B65D 55/00–024;
(Continued)

(56) References Cited

U.S. PATENT DOCUMENTS 3,991,904 A 11/1976 Davis et al.
5,662,233 A * 9/1997 Reid ..... B67B 7/06 215/217

(Continued)

FOREIGN PATENT DOCUMENTS

FR 1471203 A 3/1967
WO 01/94213 A2 12/2001
WO 2011147769 A1 12/2011

OTHER PUBLICATIONS

International Search Report, issued in PCT/IB2021/060606, mailed Mar. 17, 2022, Rijswijk, NL.

(Continued)

*Primary Examiner* — Kareen K Thomas
(74) *Attorney, Agent, or Firm* — ArentFox Schiff LLP; Michael Fainberg

(57) ABSTRACT

A reclosable container for fluid products is provided. The reclosable container has a containment body provided with a neck ending in a dispensing mouth, and a closure member having a gripping element beneath which lies a stopper tip for closing the dispensing mouth and a removable collar associated with the gripping element along a preestablished break area and rigidly attachable to the neck. In a closed configuration, the dispensing mouth is completely covered by the closure member so that it is not possible for a user's fingers to come into contact with the dispensing mouth when opening the container, avoiding contamination of calibrated drops of the fluid products.

10 Claims, 7 Drawing Sheets

(51) Int. Cl.
*B65D 39/00* (2006.01)
*B65D 55/02* (2006.01)
*B65D 71/00* (2006.01)

(52) U.S. Cl.
CPC ..... *B65D 55/024* (2013.01); *B65D 71/00* (2013.01); *B65D 2401/15* (2020.05)

(58) Field of Classification Search
CPC ..... B65D 71/00; B65D 2401/00–15; B65D 1/095
See application file for complete search history.

(56) References Cited

U.S. PATENT DOCUMENTS 6,454,126 B1 * 9/2002 Battegazzore ..... B65D 41/3447 222/530
6,510,957 B2 * 1/2003 Gilley ..... B65D 39/0011 215/296
6,651,834 B2 * 11/2003 Wong ..... B65D 81/2038 116/272
7,533,781 B1 * 5/2009 Spooner ..... B65D 39/0011 215/296
D606,400 S * 12/2009 Douglas ..... D9/451
8,807,363 B1 * 8/2014 Gilliam ..... B65D 39/0076 215/355
2003/0095253 A1 * 5/2003 Chow ..... B65D 55/028 356/240.1
2004/0031770 A1 * 2/2004 Gardner ..... B65D 1/0246 215/297
2004/0232102 A1 * 11/2004 Gardner ..... B65D 39/0011 215/296
2013/0319253 A1 * 12/2013 Smith ..... B01F 23/23412 99/323.1

OTHER PUBLICATIONS

Search Report issued in IT 202000029303, mailed Aug. 26, 2021, The Hague, NL.

* cited by examiner

RECLOSABLE CONTAINER WITH PROTECTION FOR THE DISPENSING MOUTH

CROSS-REFERENCE TO RELATED APPLICATIONS

This application is a National Phase Application of PCT International Application No. PCT/IB2021/060606, having an International Filing Date of Nov. 16, 2021 which claims priority to Italian Application No. 102020000029303 filed Dec. 1, 2020, each of which is hereby incorporated by reference in its entirety.

FIELD OF THE INVENTION

The subject matter of the present invention is a reclosable container, particularly for fluid products, such as pharmaceutical, medicinal, and cosmetic products, normally made by injection molding of a polymer material.

BACKGROUND OF THE INVENTION

There are known containers in the field that are used to package one or more doses of fluid products in paste, gel, or liquid form; depending on the number of doses, they may be single-use or multiple-use containers, and therefore reclosable.

In the field of pharmaceutical products, there are known reclosable containers made of polymer material that comprise two separate parts made separately and then assembled. A first part consists of a body containing a predetermined dose of product, provided with a neck ending in a mouth for dispensing the product. A second part consists of closure means that can be coupled to said body, provided with a stopper tip that can be inserted into the dispensing mouth so as to close it, and a gripping part above the stopper tip.

These containers may be produced in individual units or combined together in series (strips or five-vial assemblies); in the latter case, the containment bodies of two adjacent containers are temporarily joined together by means of laterally-protruding flanges with predefined break lines.

One of the typical drawbacks of the known containers is the fact that, although the closure means do indeed close the dispensing mouth, they do not ensure a complete covering of the annular rim of the neck defining said dispensing mouth. Note that said annular rim is an essential element in order to be able to dispense calibrated drops of product. Indeed, it is known that the dimensions of the drops of product, and consequently the number of doses dispensable by the container, are a function of the diameter of the outside perimeter of the neck wall lying within the plane of the dispensing mouth. So, when dispensing, the calibrated drop of product comes into contact with the outer surface of the container right at the annular rim of the neck. Note that during use, the user opens the container by removing the closure means and gripping the gripping part, which is immediately above the stopper tip inserted into and closing the dispensing mouth. During this operation, the user's fingers inevitably end up coming into contact with the annular rim of the container neck, with the risk of contaminating it; consequently, the calibrated drops of product also risk being contaminated by microbes and bacteria. WO 2011/147769 A1 and FR 1 471 203 A show examples of reclosable containers in which the closure means completely cover the dispensing mouth.

In addition, in order to handle the containment body in an easy and practical way when dispensing the product, the user will often put the closure means momentarily on a support surface with the risk of also contaminating the stopper tip. Once the product has been administered, the closure means are reused and the stopper tip is reinserted to close the dispensing mouth. However, while the stopper tip is sitting on the support surface, it risks being contaminated by microbes and bacteria, and upon being reinserted into the dispensing mouth, it risks also contaminating the remaining product in the container intended for subsequent uses.

Consequently, the known reclosable containers do not ensure product integrity during subsequent uses.

There is therefore a need in this field for a reclosable container, particularly for pharmaceutical products, that limits contamination of the product by microbes and bacteria during times of use.

SUMMARY OF THE INVENTION

The purpose of the present invention is to make a reclosable container for pharmaceutical products that solves the problems of the prior art, bearing in mind the needs in the field.

In particular, the purpose of the present invention is to provide a reclosable container for fluid pharmaceutical products that limits the risk of contamination of the product by microbes and bacteria during times of use.

In addition, the purpose of the present invention is to provide a reclosable container for fluid pharmaceutical products that can be used in an easy, practical, and functional way and that has a particularly compact and small overall size.

BRIEF DESCRIPTION OF THE FIGURES

This purpose is achieved by a reclosable container for fluid products and by a monolithic strip of reclosable containers as described and claimed herein. Preferred embodiments of the present invention are also described.

The features and advantages of a container according to the present invention will become apparent from the following description, given as a non-limiting example and in accordance with the accompanying figures, in which.

DETAILED DESCRIPTION

In reference to the appended figures, reference number 1 refers to a reclosable container for fluid products, particularly for medicinal, pharmaceutical, and cosmetic products.

Here, it should be noted that the term "fluid products" is not only intended to refer to liquid products, but also viscous products, for example in the form of a paste and gel, and powdery products, in particular very fine powders with a high degree of fluidity.

The container 1 comprises a containment body 10 intended to contain a fluid product.

Figure 10:
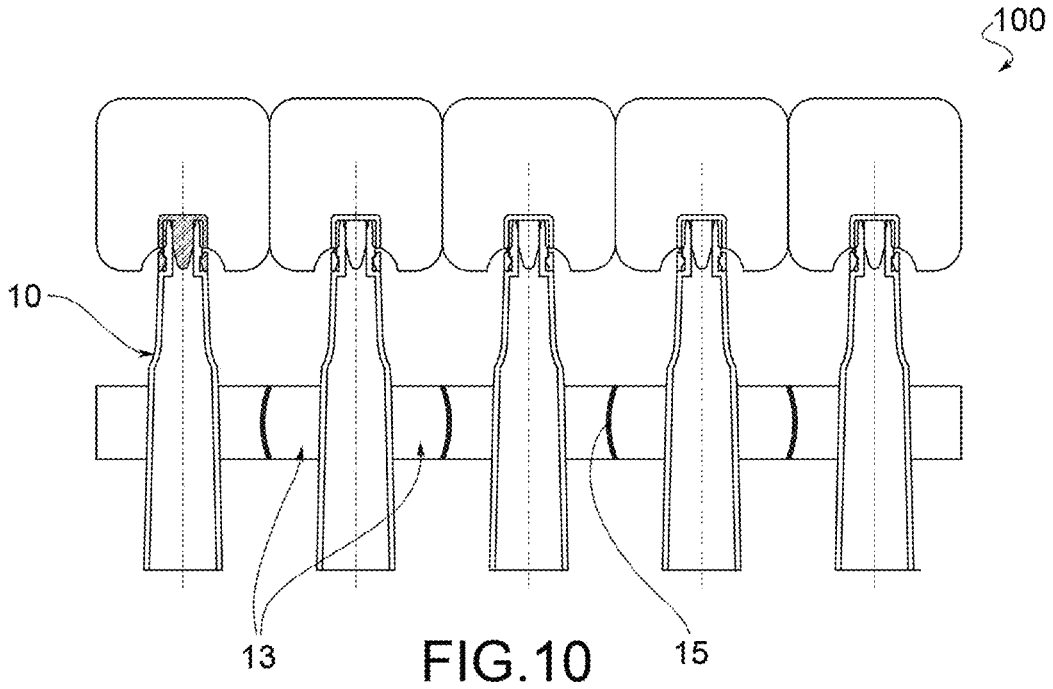
FIG. 10 shows a cross-sectional view of a series of reclosable containers according to the present invention, specifically according to the embodiment example of FIG. 1.

The containment body 10 has a substantially tubular and elongated hollow shape with, on the outer surface thereof, a pair of gripping flanges 13 which can be coupled removably to the gripping flanges of one or more adjacent containers 1 so as to form a strip 100 of containers 1 (FIG. 10).

One end of the containment body 10 extends into a neck 11 provided with a dispensing mouth 12 for the fluid product to come out.

The neck 11 is substantially cylindrical, with a smaller diameter than the rest of the containment body 10 and coaxially aligned therewith.

The dispensing mouth 12 is closed by a closure means 2 comprising a gripping element 21, from which at least one stopper tip 22, which may be inserted into the dispensing mouth 12, extends in a substantially coplanar way.

The gripping element 21 has a substantially flat shape and comprises two side portions 211 that extend from opposite sides of the stopper tip 22. In other words, the gripping element 21 is shaped so as to define a cavity 222 made between the two side portions 211.

The closure means 2 comprises an annular-shaped fixed collar 23 made as an integral part with the gripping element 21.

The fixed collar 23 extends at least partially into the cavity 222 between the two side portions 211 of the gripping element 21.

The fixed collar 23 comprises a bottom 232 and an opening 233 on the opposite side. A stopper seat 231 is defined between the bottom 232 and the opening 233. Indeed, the stopper tip 22 extends into the stopper seat 231 from the bottom 232.

Preferably, the stopper tip 22 does not protrude from the opening 233 of the fixed collar 23, as shown in the examples of FIGS. 4, 6, 7, and 9. In other words, the stopper tip 22 is completely contained inside the stopper seat 231 of the fixed collar 23. Advantageously, there is consequently no risk of the stopper tip 22 becoming contaminated, even if the closure means 2 is placed on a support surface.

Figure 1:
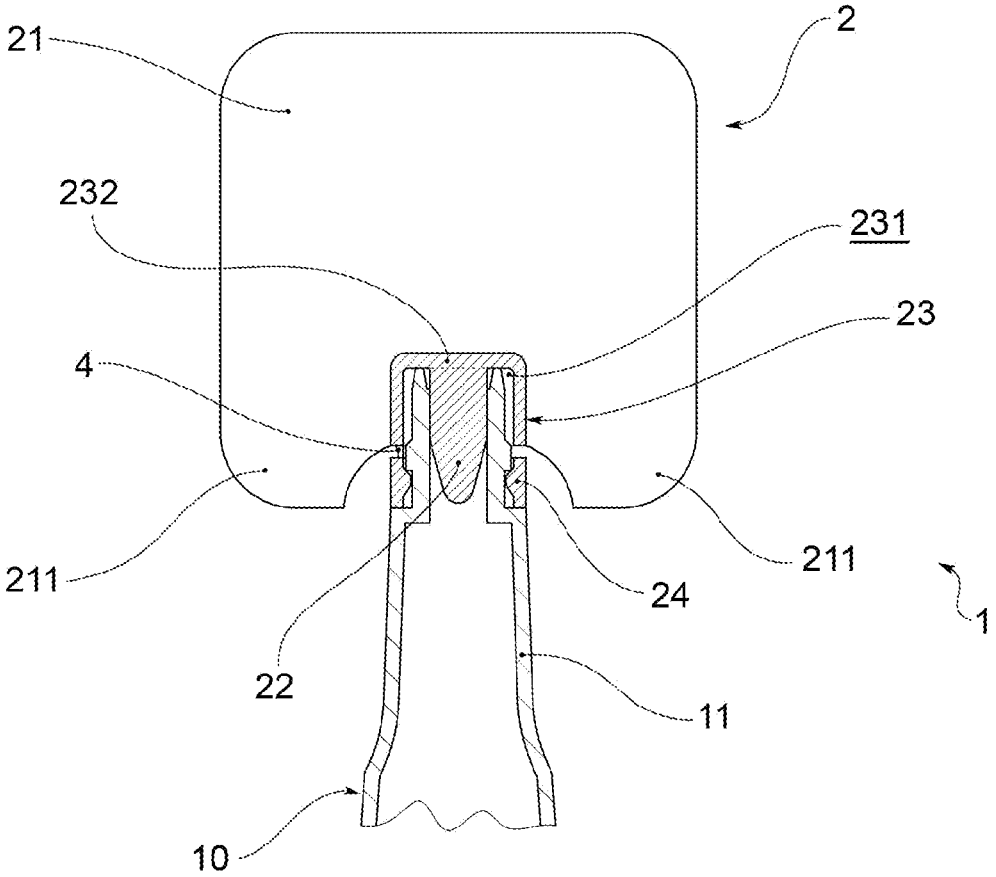
FIG. 1 is a cross-sectional view of a reclosable container according to a present invention, in an embodiment example.
Figure 4:
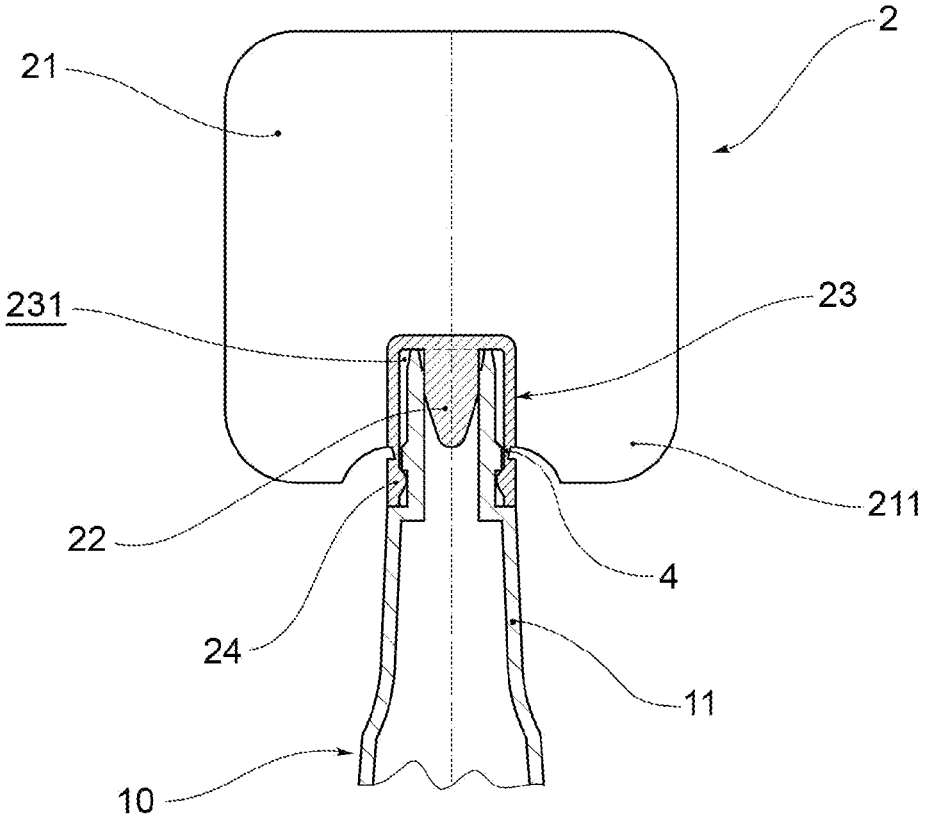
FIG. 4 shows a cross-sectional view of a reclosable container according to the present invention in another embodiment example.
Figure 7:
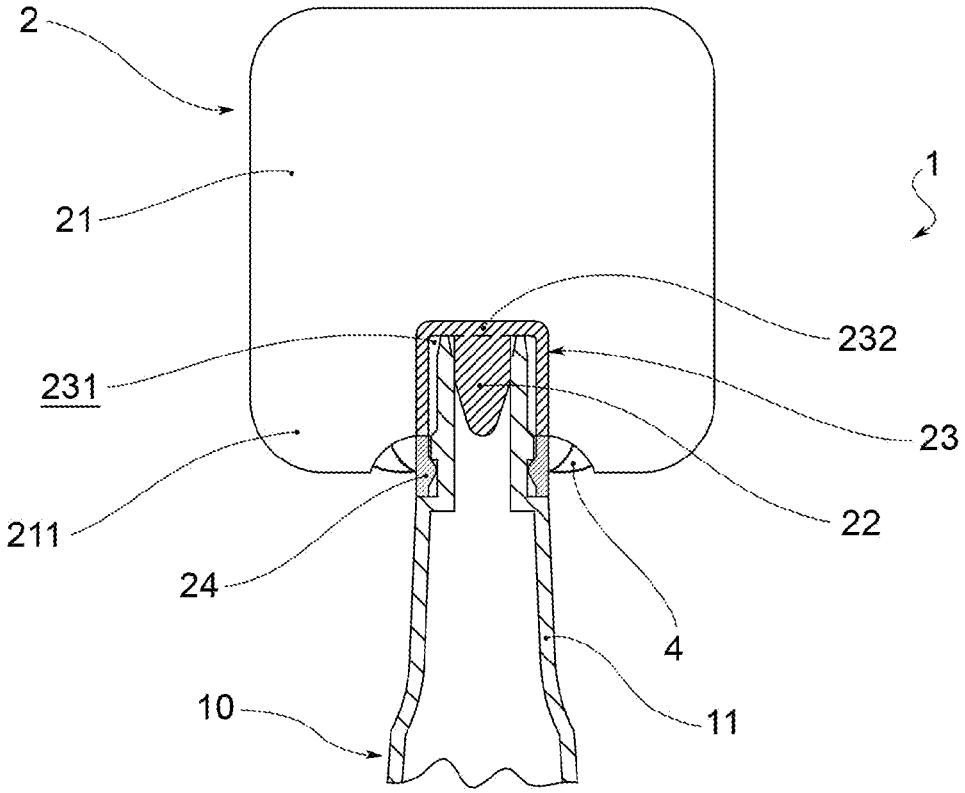
FIG. 7 shows a cross-sectional view of a reclosable container according to the present invention in yet another embodiment example.

The fixed collar 23 is arranged in such a way that, once assembled to the closure means 2 on the containment body 10, and in particular on the neck 11, the dispensing mouth 12 remains completely covered. In other words, with container 1 according to the present invention in the closed configuration, the dispensing mouth 12 of the containment body 10 is completely contained inside the stopper seat 231 of the fixed collar 23, as shown in FIGS. 1, 4 and 7. Advantageously, then, there is no risk that the user's fingers will come into contact with the dispensing mouth 12 and with the annular rim of the neck 11, entailing a risk of contamination, when opening the container 1.

The closure means 2 comprises an annular-shaped removable collar 24 associated with the gripping element 21 along at least one preestablished break area 4.

Figure 2:
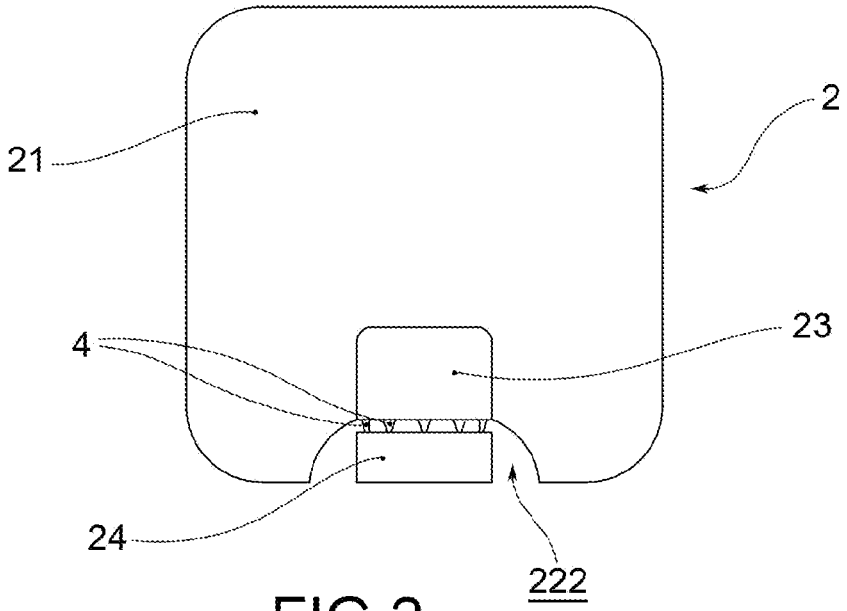
FIG. 2 shows a front view of a component of the reclosable container in FIG. 1, specifically of the closure means.
Figure 3:
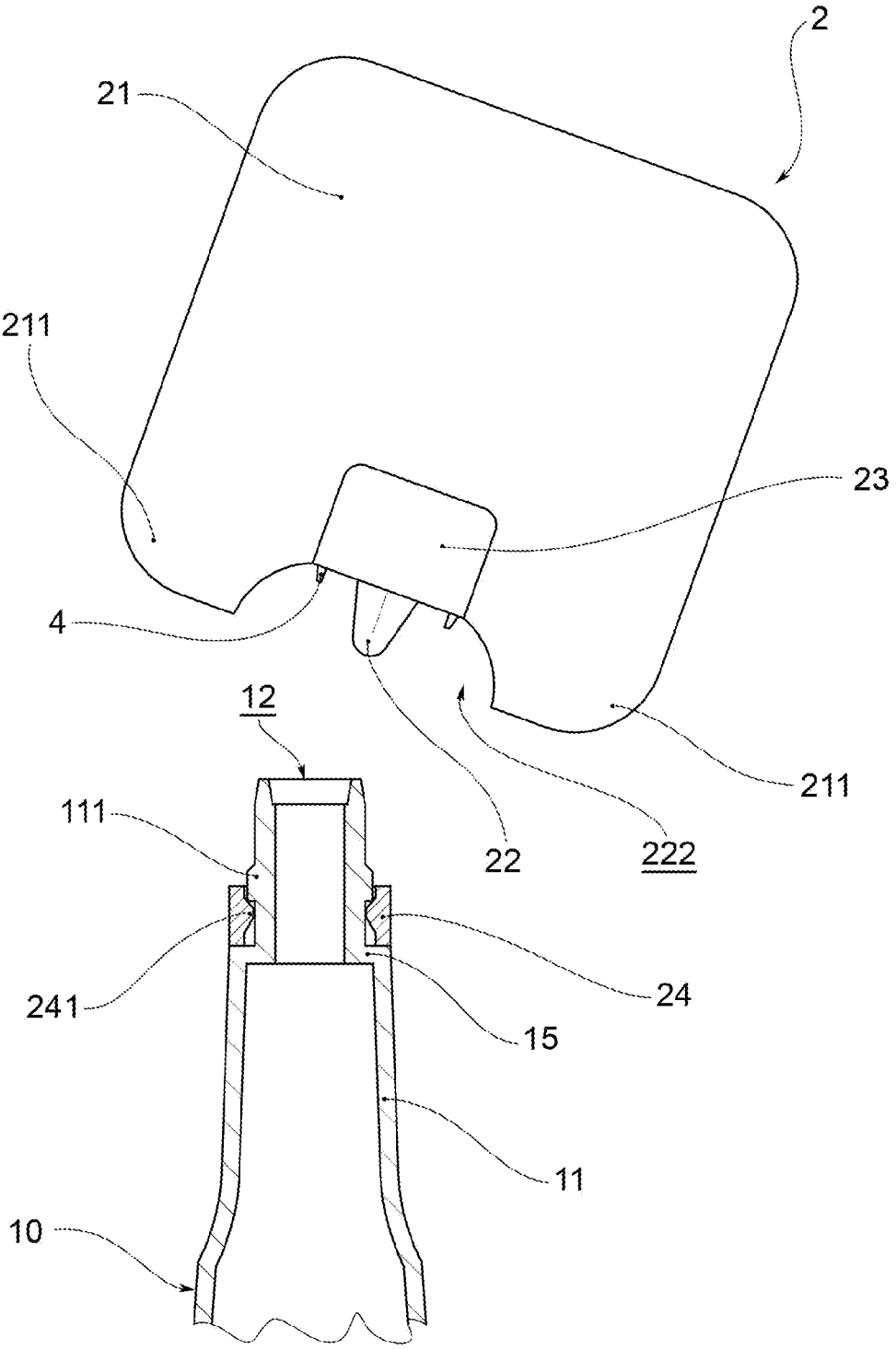
FIG. 3 shows a cross-sectional view of the reclosable container in FIG. 1 in the open phase.

In one embodiment example shown in FIGS. 1 to 3, the preestablished break area 4 consists of a plurality of vertical breakable tabs connecting the lower edge of the fixed collar 23 to the upper edge of the removable collar 24.

Figure 5:
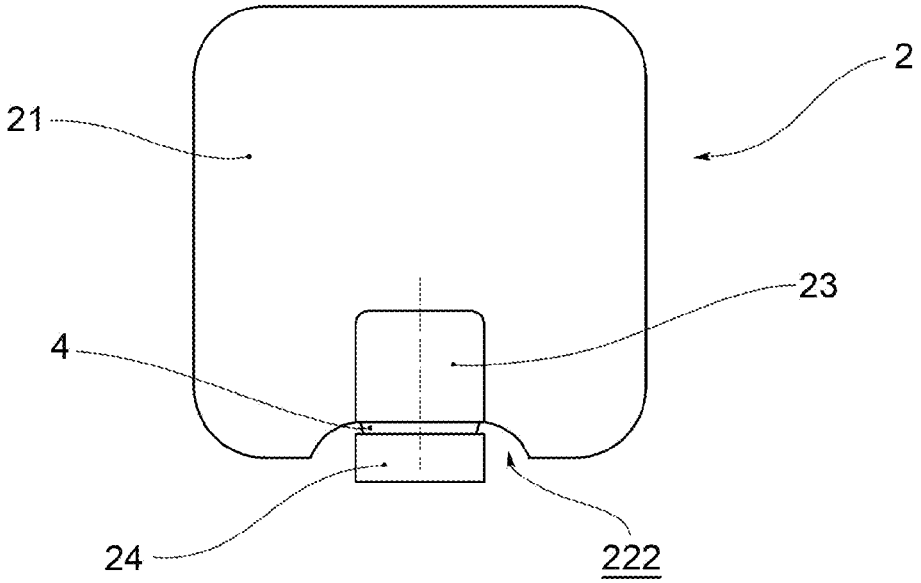
FIG. 5 shows a front view of a component of the reclosable container in FIG. 4, specifically of the closure means.
Figure 6:
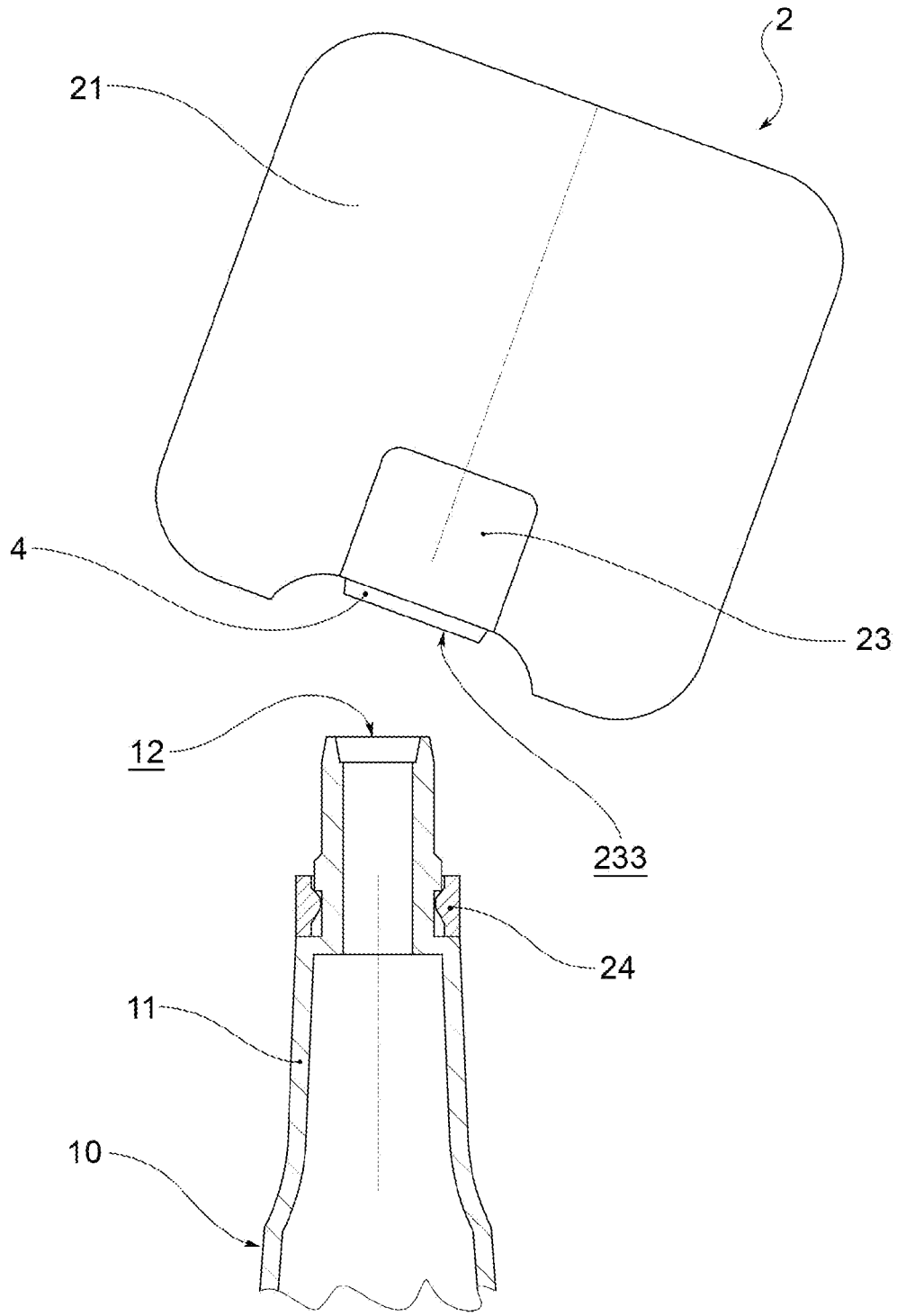
FIG. 6 shows a cross-sectional view of the reclosable container in FIG. 4, in the open phase.

In one embodiment example shown in FIGS. 4 to 6, the preestablished break area 4 consists of a breakable annular diaphragm connecting the lower edge of the fixed collar 23 to the upper edge of the removable collar 24.

Figure 8:
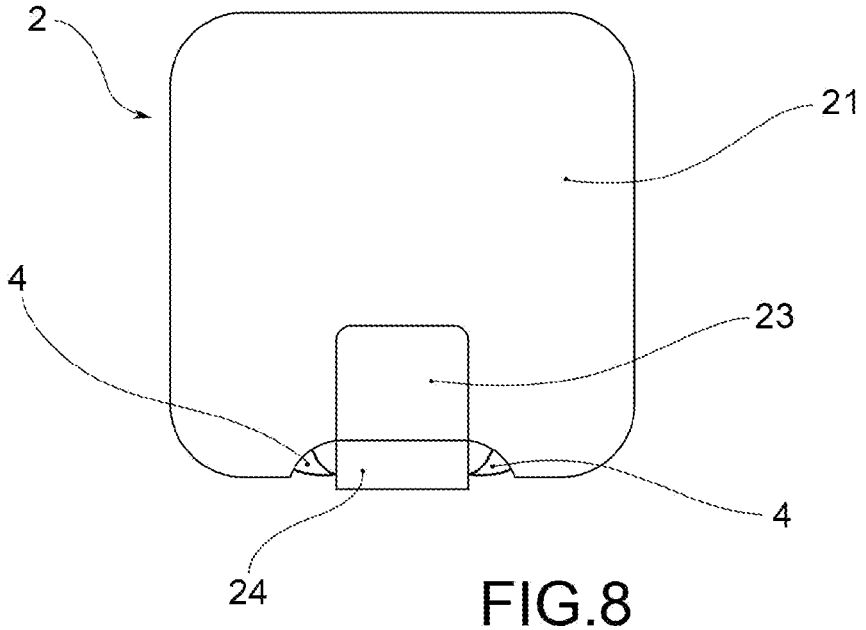
FIG. 8 shows a front view of a component of the reclosable container in FIG. 7, specifically of the closure means.
Figure 9:
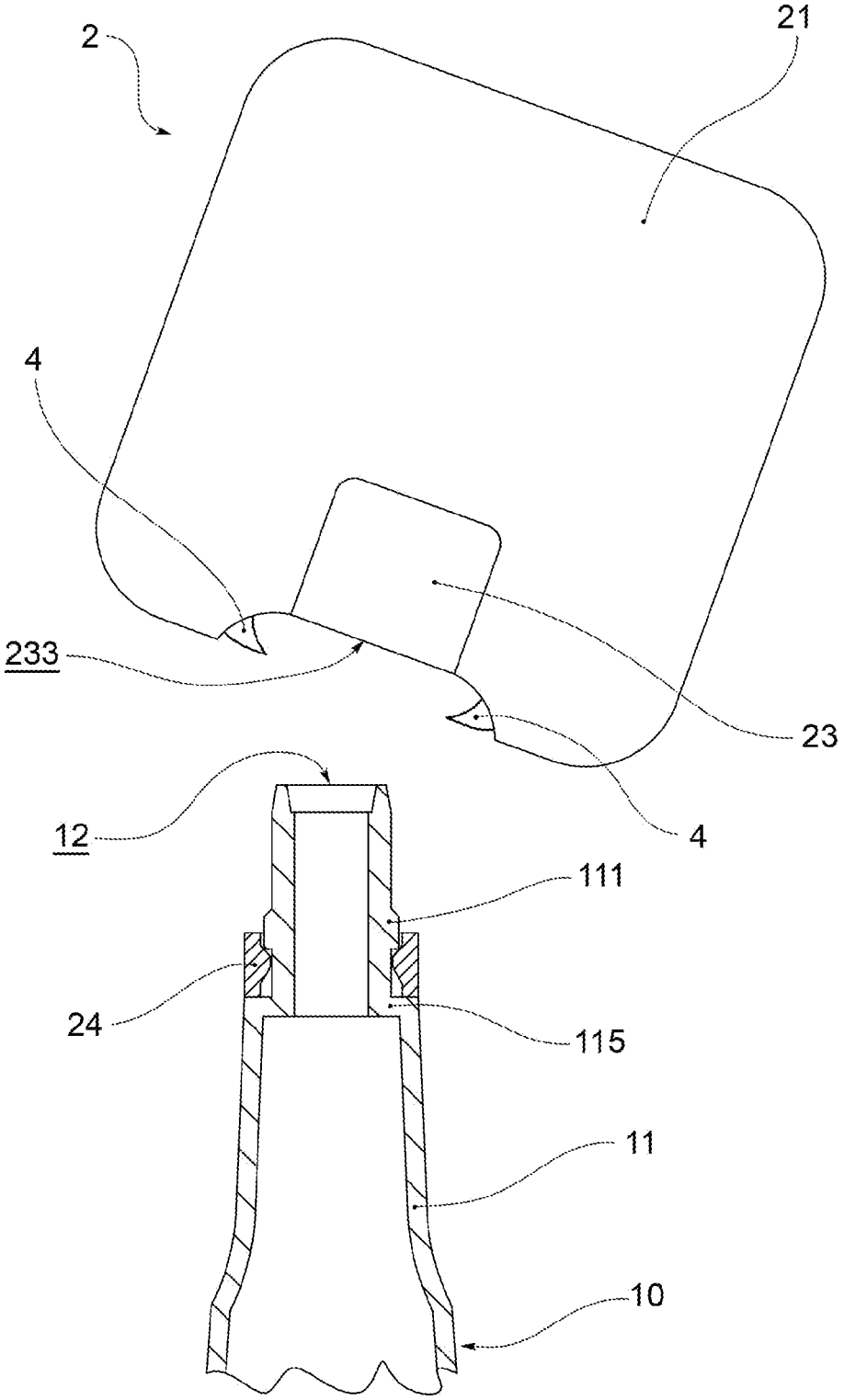
FIG. 9 shows a cross-sectional view of the reclosable container in FIG. 7, in the open phase.

In one embodiment example shown in FIGS. 7 to 9, the preestablished break area 4 consists of a pair of lateral breakable tabs connecting the side portions 211 to the outer surface of the removable collar 24 arranged on diametrically opposite sides of the removable collar 24.

The removable collar 24 is able to fit around the neck 11 and is intended to be made secured thereto.

Indeed, interlocking connection means are placed between the neck 11 and the removable collar 24.

In particular, the interlocking connection means comprise a ring 111 extending from the outer surface of the neck 11 and connectable to a stop ring 241 extending from the inner surface of the removable collar 24.

Alternative forms of coupling between the neck 11 and the removable collar 24 are also possible, for example by welding such as by heat or ultrasound, or by adhesive.

Preferably, the neck 11 is provided with a stop element 115, substantially a ledge, defining a stop for the closure means 2. In other words, when the closure means 2 is mounted on the containment body 10, the lower edge of the removable collar 24 rests against the stop element 115 of the neck 11. Indeed, a seat is defined between the stop element 115 and the ring 111 of the neck 11 in which the removable collar 24 remains locked, even after the closure means 2 has been opened.

Note, furthermore, that the gripping element 21, the stopper tip 22, the fixed collar 23, and the removable collar 24 are made as an integral part, for example by forming techniques such as injection molding, using polymer materials such as polyethylene or polypropylene. Similarly, the containment body 10 may also be made by the same forming techniques as the closure means 2, in a separate mold.

Figure 11:
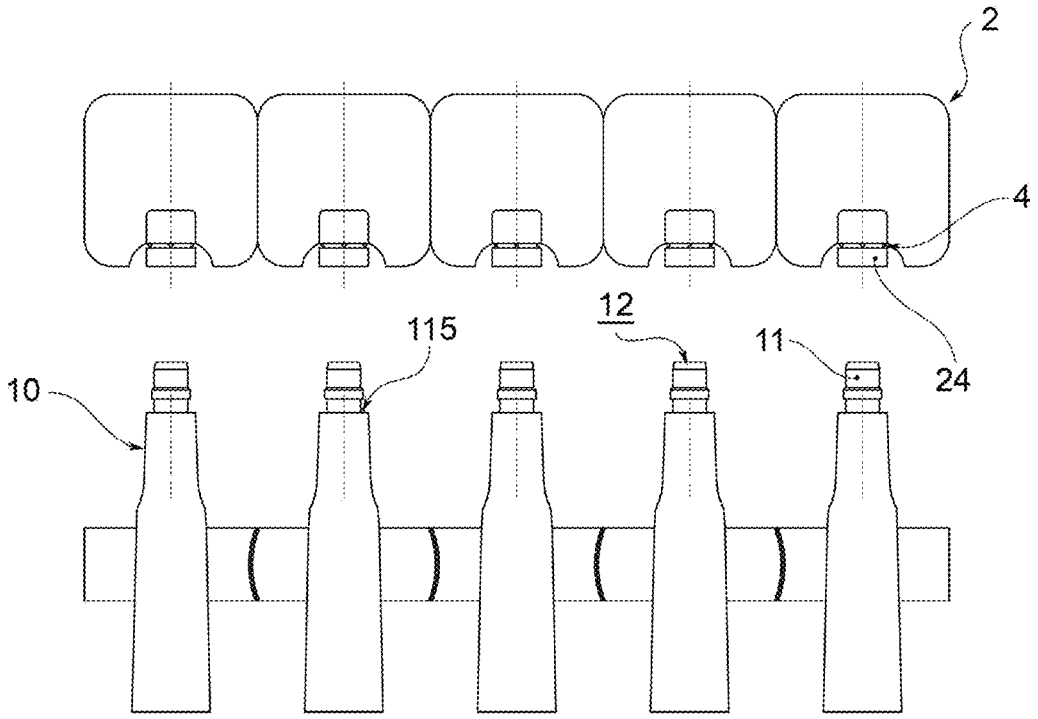
FIG. 11 shows the series of reclosable containers in FIG. 10, when the closure means are being assembled with the containment body.

The containment body 10 is therefore initially separate from the closure means 2, as shown in FIG. 11, and the container 1 is assembled in a second step in which the removable collar 24 is fitted to the neck 11, with simultaneous insertion of the stopper tip 22 into the dispensing mouth 12, as shown in FIG. 10.

At the time of first use, the user opens the container 1 by removing the closure means 2 by gripping the gripping element 21. This removal entails withdrawal of the stopper tip 22 from the dispensing mouth 12, while the removable collar 24 remains on the neck 11 after breakage of the preestablished break area 4 to serve a "tamper-evident" function to show the container has been opened. Thanks to the presence of the stop element 115, the removable collar 24 cannot slide along the neck 11. Thanks to the ring 111, the removable collar 24 may not slide off the neck 11 and risk being swallowed, for example by a child. The removable collar 24 therefore advantageously remains confined to the seat defined between the stop element 115 and the ring 111 of the neck 11.

The subject matter of the present invention is therefore a reclosable container 1 for fluid products in which the dispensing mouth 12 of the containment body 10 is completely contained inside the stopper seat 231 of the fixed collar 23 in order to limit the risk of contamination of the product by microbes and bacteria during times of use.

The subject matter of the present invention is also a monolithic strip of reclosable containers 1 for fluid products. In one example, the strip comprises five containers 1, as in FIG. 10. Each container 1 is provided with a pair of flanges 14 protruding from the outer side surface of the containment body 10. In the monolithic strip of containers, each flange 14 is removably connected to a flange 14 of one or more adjacent reclosable containers by means of a weakened area 15.

Innovatively, a reclosable container for fluid pharmaceutical products according to the present invention keeps the risk of product contamination by microbes and bacteria during times of use to a minimum.

Advantageously, a container for fluid pharmaceutical products according to the present invention is provided with closure means that ensure the annular rim of the neck defining the dispensing mouth is covered. As a result, it is not possible for the user's fingers to come into contact with said annular rim when opening the container, thus avoiding contamination of the calibrated drop of product.

Advantageously, a container for fluid pharmaceutical products according to the present invention is provided with closure means that, in one embodiment example, ensure that the stopper tip is also covered. As a result, it is not possible for said tip to be contaminated when the closure means are sitting on a support surface, thus avoiding contamination of the remaining product in the container intended for later use.

It is understood that a person skilled in the art could make modifications to the container described above, all of which are contained within the scope of protection as defined by the following claims.

What is claimed is:

1. A reclosable container for fluid products, comprising:

a containment body for containing a fluid product, provided with a neck ending in a dispensing mouth for dispensing said fluid product;

a closure means for closing the dispensing mouth, comprising:

a gripping element, a stopper tip for closing said dispensing mouth extending below the gripping element, a removable collar associated with the gripping element along at least one preestablished break area, and rigidly attachable to said neck, wherein, in a closed configuration, the closure means is engaged with the containment body by the removable collar, so that the stopper tip is inserted into the dispensing mouth, and in an open configuration, obtained by tearing said at least one preestablished break area, the stopper tip is separated from the containment body to open the dispensing mouth, and wherein, in the closed configuration, the dispensing mouth is completely covered by the closure means; and a ring extending from an outer surface of the neck and connectable to a stop ring extending from an inside surface of the removable collar;

wherein the reclosable container further comprises a stop element in a form of a ledge on the neck so that a seat is defined between the stop element and the ring in which the removable collar remains locked.

2. The reclosable container of claim 1, wherein the closure means comprises a fixed collar arranged between the gripping element and the removable collar, said fixed collar comprising a stopper seat, and wherein the dispensing mouth is completely contained within said stopper seat.

3. The reclosable container of claim 1, wherein the closure means comprises a fixed collar arranged between the gripping element and the removable collar, said fixed collar comprising a bottom, and wherein the stopper tip extends from the bottom.

4. The reclosable container of claim 1, wherein the closure means comprises a fixed collar arranged between the gripping element and the removable collar, said fixed collar comprising a stopper seat, and wherein the stopper tip is completely contained within said stopper seat.

5. The reclosable container of claim 1, wherein the closure means comprises a fixed collar arranged between the gripping element and the removable collar, and wherein said at least one preestablished break area consists of a plurality of vertical breakable tabs connecting a lower edge of the fixed collar to an upper edge of the removable collar.

6. The reclosable container of claim 1, wherein the closure means comprises a fixed collar arranged between the gripping element and the removable collar, and wherein said at least one preestablished break area consists of an annular breakable diaphragm connecting a lower edge of the fixed collar to an upper edge of the removable collar.

7. The reclosable container of claim 1, wherein the closure means comprises a fixed collar arranged between the gripping element and the removable collar, and wherein said at least one preestablished break area consists of a pair of breakable side tabs connecting side portions of the gripping element to an outer surface of the removable collar, said pair of breakable side tabs being arranged on diametrically opposite sides of the removable collar.

8. The reclosable container of claim 2, wherein the gripping element, the stopper tip, the fixed collar, and the removable collar are made as an integral part.

9. The reclosable container of claim 1, further comprising a pair of flanges protruding from an outer side surface of the containment body.

10. A monolithic strip of reclosable containers for fluid products, comprising a plurality of reclosable containers according to claim 9, wherein each flange is removably connected to a flange of one or more adjacent reclosable containers by a weakened area.

* * * * *